US011213184B2

(12) United States Patent
Zhang et al.

(10) Patent No.: US 11,213,184 B2
(45) Date of Patent: Jan. 4, 2022

(54) SPRAY ARM ASSEMBLY AND WASHING APPLIANCE HAVING SAME

(71) Applicants: FOSHAN SHUNDE MIDEA WASHING APPLIANCES MANUFACTURING CO., LTD., Guangdong (CN); MIDEA GROUP CO., LTD., Guangdong (CN)

(72) Inventors: Jingyi Zhang, Guangdong (CN); Liming Zhao, Guangdong (CN); Haoping Xiong, Guangdong (CN); Wangchun Fei, Guangdong (CN)

(73) Assignees: FOSHAN SHUNDE MIDEA WASHING APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 16/919,214

(22) Filed: Jul. 2, 2020

(65) Prior Publication Data

US 2020/0329943 A1 Oct. 22, 2020

Related U.S. Application Data

(63) Continuation of application No. PCT/CN2019/094247, filed on Jul. 1, 2019.

(30) Foreign Application Priority Data

Aug. 28, 2018 (CN) ..... 201810988941.9
Aug. 28, 2018 (CN) ..... 201810990354.3
(Continued)

(51) Int. Cl.
*A47L 15/22* (2006.01)
*A47L 15/23* (2006.01)
*B05B 13/02* (2006.01)

(52) U.S. Cl.
CPC ..... *A47L 15/22* (2013.01); *A47L 15/23* (2013.01); *B05B 13/02* (2013.01)

(58) Field of Classification Search
None
See application file for complete search history.

(56) References Cited

U.S. PATENT DOCUMENTS

2017/0172370 A1* 6/2017 Feddema ..... A47L 15/502

FOREIGN PATENT DOCUMENTS

CN 203711186 U 7/2014
CN 206603647 U 11/2017
(Continued)

OTHER PUBLICATIONS

International Search Report and Written Opinion dated Sep. 2, 2019 received in International Application No. PCT/CN2019/094247 together with an English language translation.

*Primary Examiner* — Levon J Shahinian
(74) *Attorney, Agent, or Firm* — Scully Scott Murphy & Presser

(57) ABSTRACT

A spray arm assembly and a washing appliance having the same are disclosed. The spray arm assembly includes a spray arm, a spray arm seat, and balls. The spray arm is connected to the spray arm seat, and the spray arm is rotatable relative to the spray arm seat. The balls are provided at positions where the spray arm and the spray arm seat are connected and fitted.

26 Claims, 6 Drawing Sheets

(30) Foreign Application Priority Data

Aug. 28, 2018 (CN) ..... 201821415527.0
Aug. 28, 2018 (CN) ..... 201821415623.5

(56) References Cited

FOREIGN PATENT DOCUMENTS

| | | | |
|---|---|---|---|
| CN | 207356051 | U | 5/2018 |
| CN | 208973736 | U | 6/2019 |
| CN | 208973738 | U | 6/2019 |
| CN | 209032217 | U | 6/2019 |

* cited by examiner

SPRAY ARM ASSEMBLY AND WASHING APPLIANCE HAVING SAME

CROSS-REFERENCE TO RELATED APPLICATION

The present application is a continuation of PCT International Application No. PCT/CN2019/094247, filed on Jul. 1, 2019, which claims priority to and benefits of Chinese Application No. 201810990354.3, titled "Spray Arm Assembly and Washing Appliance Having Same", Chinese Application No. 201821415623.5, titled "Spray Arm Assembly and Washing Appliance Having Same", Chinese Application No. 201810988941.9, titled "Spray Arm Assembly and Washing Appliance", and Chinese Application No. 201821415527.0, titled "Spray Arm Assembly and Washing Appliance", all filed on Aug. 28, 2018, the entire contents of which are incorporated herein by reference for all purposes. No new matter has been introduced.

FIELD

The present disclosure relates to a technical field of household appliances, and more particularly to a spray arm assembly and a washing appliance having the same.

BACKGROUND

At present, washing appliances, such as dishwashers, are getting popular among users thanks to the convenience provided by the appliances. Generally speaking, the cleaning performance of the washing appliances is the most prioritized by users. One factor that affects the cleaning performance of washing appliances is spray arms of the washing appliances. When washing appliances are working, spray arms rotate and spray washing liquid to dishes at a high speed to achieve the purpose of cleaning the dishes. In the related art, the main method to connect a spray arm and a spray arm seat is using a snap-fit connection with flanges, but this connection method may cause a large gap between the spray arm and the spray arm seat. When the spray arm is working, water in the spray arm can easily leak away through the gap, degrading the cleaning effect. In addition, when relative movement occurs between the spray arm and the spray arm seat, friction between the two is sliding friction, so the lost hydrodynamic power is relatively considerable. Moreover, the snap-fit connection directly leads to a large height size of the spray arm seat and the spray arm, which causes space-wasting in an inner container of the washing appliance and reduced space for placing parts to be cleaned inside the washing appliance.

SUMMARY

The present disclosure solves one of the technical problems in the related art to a certain extent. Accordingly, the present disclosure proposes a spray arm assembly that may reduce friction between a spray arm and a spray arm seat.

The present disclosure further proposes a washing appliance having the above spray arm assembly.

The spray arm assembly according to embodiments of the present disclosure includes: a spray arm; a spray arm seat, the spray arm being connected to the spray arm seat and being rotatable with respect to the spray arm seat; and balls provided at positions where the spray arm is connected to and fitted with the spray arm seat.

For the spray arm assembly according to the embodiments of the present disclosure, by providing the spray arm seat, a connection interface is provided for the spray arm, and the spray arm seat also functions as a water inlet pipe for the spray arm. By providing the balls between the spray arm and the spray arm seat, the spray arm and the spray arm seat are in rolling contact, and the friction between the spray arm and the spray arm seat is reduced, which may reduce the hydrodynamic loss, improve the utilization rate of the hydrodynamic power, and ensure a large pressure of the water sprayed from the spray hole of the spray arm 100, thereby improving the cleaning effect of the dishwasher on the tableware. At the same time, the spray arm and the spray arm seat are connected by the balls, which may effectively lower a height of a water inlet of the spray arm and maximize the internal space of the dishwasher.

In some embodiments of the present disclosure, the spray arm assembly further includes a carrier base. The carrier base and the balls constitute a ball assembly, the ball assembly is disposed at the position where the spray arm is connected to and fitted with the spray arm seat, and the balls are rotatably disposed on the carrier base.

In some embodiments of the present disclosure, the carrier base at least includes an inner sleeve, and an outer circumferential surface of the inner sleeve is provided with an inner sleeve ball groove fitted with the balls.

Further, the carrier base further includes an intermediate sleeve fitted over the inner sleeve; the intermediate sleeve is provided with a plurality of ball holes, and the balls are mounted in the ball holes; each ball protrudes beyond an inner circumferential surface and an outer circumferential surface of the intermediate sleeve in a radial direction of the intermediate sleeve.

Optionally, the carrier base further includes an outer sleeve, and an inner circumferential surface of the outer sleeve is provided with an outer sleeve ball groove fitted with the balls.

In some embodiments of the present disclosure, the spray arm includes a spray arm body and a spray arm connecting sleeve; the spray arm connecting sleeve is disposed on a lower side of the spray arm body; and an inner circumferential surface of the spray arm connecting sleeve is provided with a spray arm ball groove fitted with the balls.

In some embodiments of the present disclosure, the spray arm includes a spray arm body and a spray arm connecting sleeve; the spray arm connecting sleeve is disposed on a lower side of the spray arm body; and an inner circumferential surface of the spray arm connecting sleeve is in interference fit with an outer circumferential surface of the outer sleeve.

Further, the spray arm ball groove and the inner sleeve ball groove are both circumferentially annular grooves.

Further, in a direction of a central axis of the spray arm connecting sleeve, positions of the spray arm ball groove, the inner sleeve ball groove, and the ball hole correspond.

In some embodiments of the present disclosure, the spray arm seat and the carrier base are detachably connected.

For example, the spray arm seat includes a spray arm seat body; the spray arm seat body has a spray arm seat snap; and the spray arm seat snap is configured to be snapped onto a top end of the inner sleeve.

For example, a top end of the spray arm seat body has a plurality of grooves, and an opening direction of each groove is parallel to an axis direction of the spray arm seat body; the spray arm seat snap extends upwardly from a bottom wall of the groove, and two sides of the spray arm seat snap are separated from two side walls of the groove; and a top end of the spray arm seat snap is provided with a hook facing the inner sleeve.

Further, a gap between lower surfaces of the spray arm connecting sleeve and the inner sleeve and an upper surface of the spray arm seat flange is represented by L1, and L1 satisfies a relationship: 0 mm<L1≤1 mm.

In some embodiments of the present disclosure, the carrier base has a base thread, the spray arm seat has a spray arm seat thread, and the spray arm seat thread is fitted with the base thread.

Optionally, the spray arm seat includes a spray arm seat body; the spray arm seat thread is an internal thread provided on an inner circumferential surface of the spray arm seat body; and the base thread is an external thread provided on the outer circumferential surface of the inner sleeve; or the spray arm seat includes a spray arm seat body; the spray arm seat thread is an external thread provided on an outer circumferential surface of the spray arm seat body; and the base thread is an internal thread provided on an inner circumferential surface of the inner sleeve.

In some embodiments of the present disclosure, each ball hole is provided in a top of the intermediate sleeve, each ball hole is a major arc hole, and a top notch of each ball hole forms a ball fetching opening.

Further, a weakening groove is provided between two adjacent ball holes.

Further, a weakening groove column is provided in the weakening groove.

In some embodiments of the present disclosure, the spray arm assembly is configured for a washing appliance; the spray arm seat includes a mounting portion, and the mounting portion defines a mounting space; the spray arm is provided with a water introduction shaft, and the water introduction shaft is at least partially mounted in the mounting space; the balls are disposed between an outer side surface of the water introduction shaft located in the mounting space and an inner side surface of the mounting portion, and the balls rollably connect the water introduction shaft and the mounting portion.

In the above spray arm assembly, when the spray arm rotates, the balls may achieve the rolling friction between the spray arm and the spray arm seat, such that a friction force between the spray arm and the spray arm seat is a rolling friction force, which reduces the loss of the power for driving the spray arm to rotate, and improves the utilization rate of the power for driving the spray arm to rotate. As a result, the pressure of the water after being sprayed outwardly from the spray hole of the spray arm is greater, which is beneficial to upgrading the cleaning effect of the spray arm assembly.

In some embodiments of the present disclosure, the outer side surface of the water introduction shaft is provided with a first ball groove along a circumferential direction of the water introduction shaft, and each ball is partially accommodated in the first ball groove.

In some embodiments of the present disclosure, the spray arm assembly includes a first connecting shaft accommodated in the mounting space; the first connecting shaft is located between the outer side surface of the water introduction shaft and the inner side surface of the mounting portion; the first connecting shaft is provided with a first shaft through-hole, and the water introduction shaft passes through the first shaft through-hole; an upper end of the first connecting shaft is provided with a ball hole, and the ball is partially accommodated in the ball hole.

In some embodiments of the present disclosure, a center of the ball hole is horizontally aligned with a center of the first ball groove.

In some embodiments of the present disclosure, the spray arm assembly includes a second connecting shaft; the second connecting shaft is at least partially accommodated in the mounting space and is connected to the mounting portion; the second connecting shaft is provided with a second shaft through-hole, and the water introduction shaft passes through the second shaft through-hole; the balls rollably connect the outer side surface of the water introduction shaft and an inner side surface of the second connecting shaft.

In some embodiments of the present disclosure, the inner side surface of the second connecting shaft is provided with a second ball groove along a circumferential direction of the second connecting shaft, and each ball is partially accommodated in the second ball groove.

In some embodiments of the present disclosure, a flange protruding toward an axis of the second connecting shaft is formed at an upper end of the second connecting shaft, and the flange partially blocks the balls.

In some embodiments of the present disclosure, an outer side surface of the second connecting shaft is formed with a thread, the inner side surface of the mounting portion is formed with a thread correspondingly, and the second connecting shaft and the mounting portion are connected by engagement between the threads.

In some embodiments of the present disclosure, the spray arm seat includes a water introduction portion connected to the mounting portion; the water introduction portion and the water introduction shaft are coaxially disposed; the water introduction shaft is provided with a first water introduction through-hole, the water introduction portion is provided with a second water introduction through-hole, and a diameter of the first water introduction through-hole is equal to a diameter of the second water introduction through-hole.

In some embodiments of the present disclosure, the spray arm seat includes a step portion connecting the mounting portion and the water introduction portion, and a gap of 0.4 to 2.2 mm is defined between a bottom of the water introduction shaft and the step portion.

The washing appliance according to embodiments of another aspect of the present disclosure includes the spray arm assembly according to any one of the above embodiments.

In some embodiments of the present disclosure, the washing appliance further includes a cavity. The spray arm assembly is mounted in the cavity, and the spray arm is located in the cavity.

In the above washing appliance, when the spray arm rotates, the balls may achieve the rolling friction between the spray arm and the spray arm seat, such that a friction force between the spray arm and the spray arm seat is a rolling friction force, which reduces the loss of the power for driving the spray arm to rotate, and improves the utilization rate of the power for driving the spray arm to rotate. As a result, the pressure of the water after being sprayed outwardly from the spray hole of the spray arm is greater, which is beneficial to upgrading the cleaning effect of the spray arm assembly.

Additional aspects and advantages of embodiments of the present disclosure will be given in part in the following descriptions, become apparent in part from the following descriptions, or be learned from the practice of the embodiments of the present disclosure.

Figure 1:
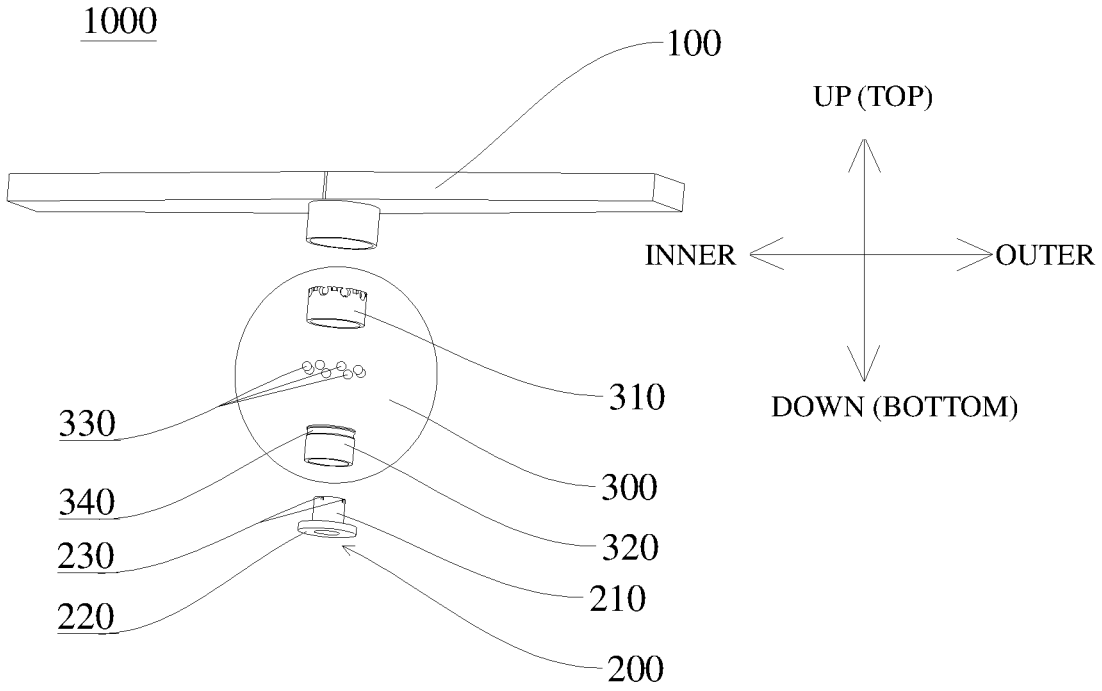
FIG. 1 illustrates an exploded view of a first embodiment of a spray arm assembly.

REFERENCE NUMERALS spray arm assembly 1000, spray arm 100, spray arm body 110, spray arm connecting sleeve 120, spray arm chamber 130, spray arm ball groove 140, spray arm seat 200, spray arm seat body 210, spray arm seat flange 220, spray arm seat snap 230, spray arm seat chamber 240, ball assembly 300, intermediate sleeve 310, ball hole 311, inner sleeve 320, ball 330, inner sleeve ball groove 340, weakening groove column 341, weakening groove 342, outer sleeve 350;

washing appliance 10000, spray arm assembly 1000, spray arm 100, water introduction shaft 112, sub-arm 114, first ball groove 1122, first water introduction through-hole 1124, spray arm seat 200, mounting portion 122, mounting space 1222, water introduction portion 124, second water introduction through-hole 1242, step portion 126, ball 330, first connecting shaft 14, first shaft through-hole 142, ball hole 311, notch 146, second connecting shaft 15, second shaft through-hole 152, second ball groove 154, flange 156, thread 158, cavity 20.

DETAILED DESCRIPTION OF EMBODIMENTS

Embodiments of the present disclosure will be described in detail below, and examples of the embodiments will be illustrated in drawings. The same or similar elements and the elements having same or similar functions are denoted by like reference numerals throughout the descriptions. The embodiments described herein with reference to the drawings are explanatory and are merely used to generally understand the present disclosure. The embodiments shall not be construed to limit the present disclosure.

In the description of the present disclosure, it is to be understood that terms such as "length," "width," "upper," "lower," "left," "right," "top," "bottom," "inner," and "outer" should be construed to refer to the orientation as then described or as shown in the drawings under discussion. These relative terms are for convenience and simplification of description and do not indicate or imply that the device or element referred to must have a particular orientation or be constructed and operated in a particular orientation. Thus, these terms shall not be construed to limit the present disclosure.

In the description of the present disclosure, it should be noted that, unless specified or limited otherwise, the terms "mounted," "connected," "coupled," "fixed," and the like are used broadly, and may be, for example, fixed connections, detachable connections, or integral connections; may also be direct connections or indirect connections via intervening structures; may also be inner communications or mutual interaction of two elements, which could be understood by those skilled in the art according to specific situations.

Figure 2:
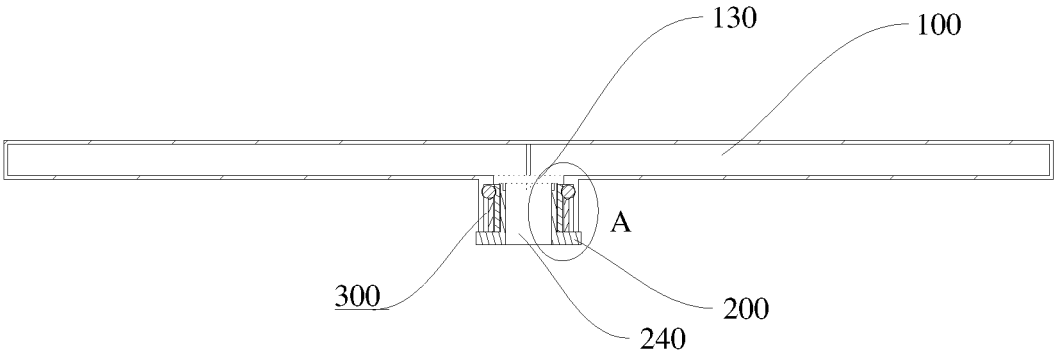
FIG. 2 illustrates a half section view of the first embodiment of the spray arm assembly.
Figure 3:
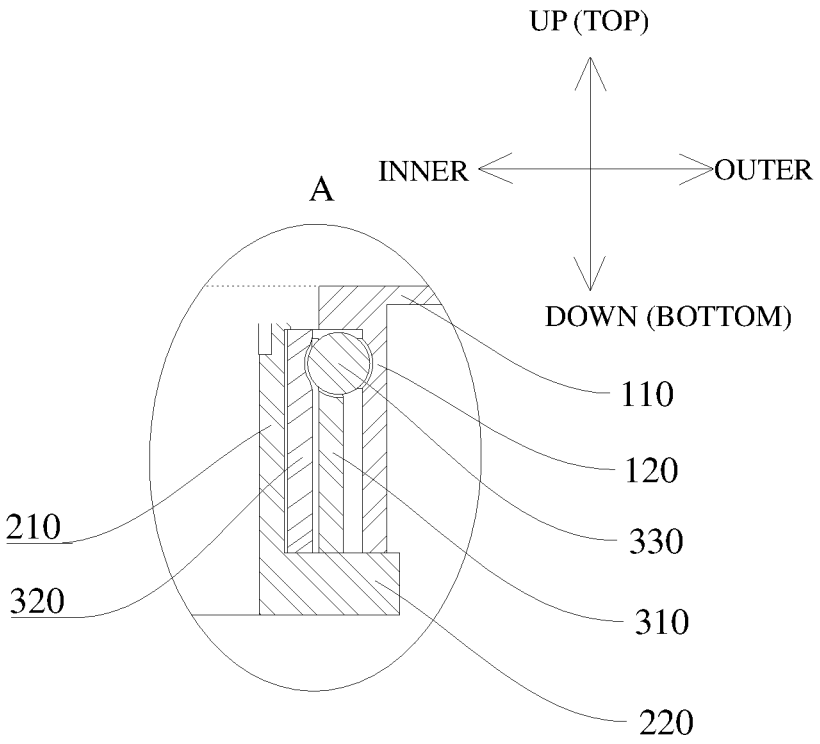
FIG. 3 illustrates an enlarged view of part A in FIG. 2.

A spray arm assembly 1000 according to embodiments of the present disclosure is described in detail below with reference to FIGS. 1-12. The spray arm assembly 1000 can be used in a washing appliance 10000, and the structure of the spray arm assembly 1000 will be described below by an example where the spray arm assembly 1000 is applied to a dishwasher. Referring to FIGS. 1-3, the spray arm assembly 1000 according to the embodiments of the present disclosure may include: a spray arm 100, a spray arm seat 200, and a plurality of balls 330.

The spray arm 100 is connected to the spray arm seat 200, and the spray arm 100 is rotatable with respect to the spray arm seat 200. The balls 330 are provided at positions where the spray arm 100 is connected to and fitted with the spray arm seat 200. By providing the spray arm seat 200, a connection interface is provided for the spray arm 100. After the spray arm 100 and the spray arm seat 200 are connected as a whole, the spray arm seat 200 may also function as a water inlet pipe for the spray arm 100. When the dishwasher is communicated with a water source, water flows from the spray arm seat 200 into the spray arm 100. In some embodiments, the spray arm 100 is provided with a water spray hole and a drive hole. When the water pressure in the spray arm 100 reaches a certain value, the spray arm 100 begins to spray water columns through the water spray hole and the drive hole, and the spray arm 100 is rotated by reaction force when the water columns are sprayed. As the water columns are continuously sprayed from the water spray hole and the drive hole, the spray arm 100 may continuously rotate, and the water columns sprayed from the water spray hole and the drive hole will be sprayed to surfaces of tableware or an inner wall of the dishwasher along with the rotation of the spray arm 100, thereby washing away stains on the tableware or the inner wall of the dishwasher, and completing the washing work of the dishwasher. The directions and positions of the water columns sprayed by the spray arm 100 onto the tableware are different, which reduces dead angles and improves the cleaning performance. Due to the large coverage of the water flow, the cleaning time may be reduced accordingly, that is, it is beneficial to shortening the cleaning time.

The spray arm assembly 1000 according to the embodiments of the present disclosure will be first described in detail with reference to FIGS. 1 to 6.

As shown in FIGS. 1-3, the spray arm assembly 1000 may further include a carrier base, and the carrier base and the balls 330 constitute a ball assembly 300. In other words, the ball assembly 300 includes the carrier base and the balls 330, and the ball assembly 300 is disposed at the position where the spray arm 100 is connected to and fitted with the spray arm seat 200. The balls 330 are rotatably disposed on the carrier base.

In the embodiment shown in FIGS. 1-3, the carrier base includes: an intermediate sleeve 310 and an inner sleeve 320. The intermediate sleeve 310 is sleeved over the inner sleeve 320. The balls 330 are in rolling contact with an inner surface of the spray arm 100 and in rolling contact with an outer surface of the inner sleeve 320. At least a part of the spray arm seat 200 is disposed inside the inner sleeve 320, and the inner sleeve 320 is fixedly connected to the spray arm seat 200. Therefore, the spray arm 100 is indirectly connected to the spray arm seat 200 by means of the ball assembly 300, and the structure in which the spray arm 100, the spray arm seat 200, and the ball assembly 300 are connected is simple and stable.

When the spray arm 100 rotates relative to the spray arm seat 200, the balls 330 roll, and relative rotation occurs between the spray arm 100 and the inner sleeve 320. Since the spray arm seat 200 and the inner sleeve 320 are fixed, the relative rotation between the spray arm 100 and the spray arm seat 200 is realized.

By providing the ball assembly 300, when the spray arm 100 rotates relative to the spray arm seat 200, friction between the spray arm 100 and the spray arm seat 200 is rolling friction rather than sliding friction. As a result, the friction is relatively small when the spray arm 100 rotates relative to the spray arm seat 200, that is, the rolling friction has little resistance to the spray arm 100 when rotating, so that the hydrodynamic loss due to friction may be reduced, and the efficiency of using the hydrodynamic power may be improved. At the same time, since the speed of the spray arm 100 when rotating relative to the spray arm seat 200 is relatively high, by providing the ball assembly 300, it is beneficial to improving the smoothness of the rotation of the spray arm 100, thereby reducing the noise of the dishwasher.

In addition, the spray arm 100 and the spray arm seat 200 are ingeniously connected as a whole by the ball assembly 300 disposed therebetween. Compared with the snap connection between the spray arm 100 and the spray arm seat 200, the height at the position where the spray arm seat 200 and the spray arm 100 are connected is reduced effectively, and the height of the spray arm assembly 1000 is hence reduced, maximizing the internal space of the dishwasher, leaving more space for tableware, and increasing the dishwasher's tableware capacity, for example, increasing the capacity by 10 mm to 40 mm.

Figure 5:
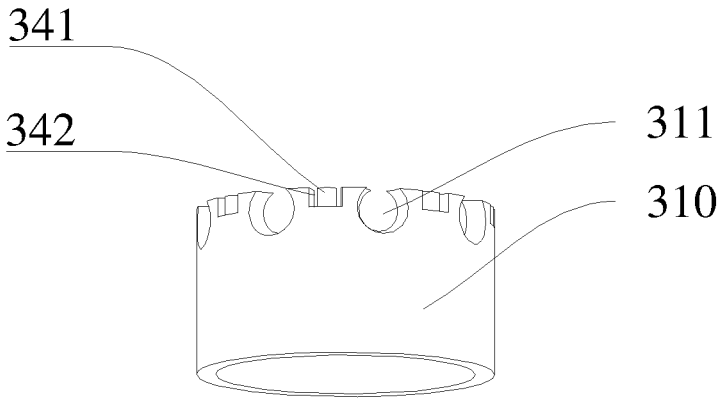
FIG. 5 illustrates a schematic view of an intermediate sleeve.

As shown in FIG. 5, the intermediate sleeve 310 is provided with a plurality of ball holes 311, and the balls 330 are rotatably mounted in the ball holes 311, respectively. The ball holes 311 provide support for the fixation of the balls 330, ensuring that the relative positions of the plurality of balls 330 remain unchanged, preventing collision and squeezing among the plurality of balls 330, and enhancing the working stability of the ball assembly 300, so as to further improve the smoothness when the spray arm 100 rotates. Optionally, the number of balls 330 is the same as the number of ball holes 311.

In a exemplary embodiment, a plurality of balls 330 may be provided and evenly distributed along a circumferential direction of the intermediate sleeve 310, thereby improving the stability when the spray arm 100 rotates. For example, the number of the balls 330 is an even number, thereby ensuring that the ball assembly 300 is stressed evenly, alleviating stress concentration.

Optionally, the ball 330 has a diameter of 3 mm to 8 mm, the number of the balls 330 is four to twelve, and the balls 330 may be plastic balls or stainless-steel balls. The working environment of the spray arm assembly 1000 is full of water, and the spray arm assembly 1000 is in a hot and humid environment for a long time, which easily causes the balls 330 to rust and become stuck. Plastic balls or stainless-steel balls have a strong anti-corrosion ability, which may effectively slow down or even avoid the rust of the balls 330.

As shown in FIGS. 1-3, each ball 330 protrudes beyond an inner circumferential surface and an outer circumferential surface of the intermediate sleeve 310 in a radial direction of the intermediate sleeve 310. That is, the diameter of each ball 330 is greater than a wall thickness of the intermediate sleeve 310, and only a central part of each ball 330 is mounted in the intermediate sleeve 310. An inner side of each ball 330 protrudes inwardly from the inner circumferential surface of the intermediate sleeve 310, and an outer side of the ball 330 protrudes outwardly from the outer circumferential surface of the intermediate sleeve 310. The balls 330 are in rolling contact with both the spray arm 100 and the inner sleeve 320, and since the inner sleeve 320 is fixedly connected to the spray arm seat 200, rolling contact can also be achieved between the balls 330 and the spray arm seat 200. The ball assembly 300 provides support for the connection between the spray arm 100 and the spray arm seat 200. When the spray arm 100 rotates relative to the spray arm seat 200, the spray arm 100 and the inner sleeve 320 are in contact with each other through the balls 330, so rolling friction can be implemented between the spray arm 100 and the inner sleeve 320.

For the spray arm assembly 1000 according to the embodiments of the present disclosure, by providing the spray arm seat 200, the spray arm 100 is offered the connection interface; meanwhile, the spray arm seat 200 also functions as the water inlet pipe for the spray arm 100; by providing the ball assembly 300 between the spray arm 100 and the spray arm seat 200, the spray arm 100 and the inner sleeve 320 are in rolling contact, and since the spray arm seat 200 is fixed to the inner sleeve 320, the friction between the spray arm 100 and the spray arm seat 200 is reduced, which may reduce the hydrodynamic loss, improve the utilization rate of the hydrodynamic power, and ensure a large pressure of the water sprayed from the spray hole of the spray arm 100, thereby improving the cleaning effect of the dishwasher on the tableware. At the same time, the spray arm 100 and the spray arm seat 200 are connected by the ball assembly 300, which may effectively lower the height of a water inlet of the spray arm 100 and maximize the usable internal space of the dishwasher.

Figure 4:
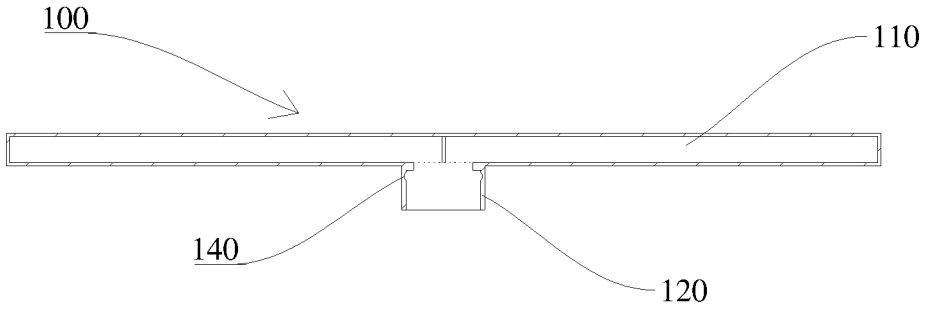
FIG. 4 illustrates a schematic view of a spray arm in the first embodiment of the spray arm assembly.

Referring to FIG. 4, the spray arm 100 may include: a spray arm body 110 and a spray arm connecting sleeve 120. The spray arm connecting sleeve 120 is provided on a lower side of the spray arm body 110. By providing the spray arm connecting sleeve 120, the connection between the spray arm 100 and the spray arm seat 200 is facilitated, which ensures that the spray arm 100 and the spray arm seat 200 may be reliably connected as a whole.

As shown in FIG. 2, the spray arm connecting sleeve 120 and the spray arm body 110 have a spray arm chamber 130 communicated therebetween, and the spray arm seat 200 has a spray arm seat chamber 240 in communication with the spray arm chamber 130. Thus, it may be ensured that the water from the water source of the dishwasher smoothly enters the spray arm chamber 130 via the spray arm seat chamber 240, and then is sprayed onto surfaces of the tableware through the spray hole and the drive hole in the spray arm 100, thus completing the operation of cleaning the tableware. As the water enters the spray arm chamber 130 continuously, the water pressure in the spray arm chamber 130 becomes higher and higher, the reaction force generated by the water column sprayed from the drive hole of the spray arm 100 is also greater, and the spray arm 100 rotates faster. In such a case, the sprayed water column hits the tableware harder, which is beneficial to washing away the stains on the tableware. Therefore, by setting the spray arm chamber 130, the cleaning effect of the dishwasher may be better.

Since the spray arm 100 and the spray arm seat 200 are connected by the ball assembly 300, the height of the spray arm connecting sleeve 120 may be reduced, thereby reducing the overall height of the spray arm assembly 1000, and providing more space for the tableware.

Further, an inner circumferential surface of the spray arm connecting sleeve 120 is provided with a spray arm ball groove 140 fitted with the balls 330, and an outer circumferential surface of the inner sleeve 320 is provided with an inner sleeve ball groove 340 fitted with the balls 330. The spray arm ball groove 140 and the inner sleeve ball groove 340 are circumferential annular grooves, thereby ensuring the smoothness of the rotation of the spray arm 100 in a full circle. The balls 330 are in rolling contact with the spray arm ball groove 140 and the inner sleeve ball groove 340, so the friction is small. In an exemplary embodiment, a diameter of the spray arm ball groove 140 and a diameter of the inner sleeve ball groove 340 may be equal to the diameter of the ball 330, or may be slightly larger than the diameter of the ball 330, thereby ensuring that the ball 330 fits well with the spray arm ball groove 140 and the inner sleeve ball groove 340.

Further, in a direction of a central axis of the spray arm connecting sleeve 120, the positions of the spray arm ball groove 140, the inner sleeve ball groove 340, and the ball hole 311 correspond to one another, and the ball 330 is partially disposed in the ball hole 311. Referring to FIGS. 2-3, the outer side of the ball 330 is in contact with the spray arm ball groove 140, and the inner side of the ball 330 is in contact with the inner sleeve ball groove 340, thereby completing the connection between the spray arm 100 and the inner sleeve 320. Since the inner sleeve 320 is fixedly connected to the spray arm seat 200, the indirect connection between the spray arm 100 and the spray arm seat 200 is achieved. Since the positions of the spray arm ball groove 140, the inner sleeve ball groove 340, and the ball hole 311 correspond to each other, it is possible to avoid inconsistency between a rolling trajectory of the ball 330 and trajectories of the spray arm ball groove 140 and the inner sleeve ball groove 340 during the rotation of the spray arm 100, which may otherwise squeeze the ball 330 and cause the spray arm 100 to be unable to rotate.

For example, the spray arm seat 200 may include: a spray arm seat body 210 and a spray arm seat flange 220. Referring to FIGS. 2-3, the spray arm seat flange 220 is disposed below the spray arm seat body 210 and extends outwardly in a radial direction of the spray arm seat body 210. An outer diameter of the spray arm seat flange 220 is larger than an outer diameter of the spray arm seat body 210. The spray arm seat flange 220 is suitable to be connected to other components in the dishwasher. Since the outer diameter of the spray arm seat flange 220 is relatively large, the fixation between the spray arm seat 200 and other components may be more stable and reliable.

In some embodiments, the spray arm seat 200 and the carrier base may be detachably connected.

As shown in FIG. 3, the ball assembly 300 is disposed above the spray arm seat flange 220. The spray arm seat body 210 has a spray arm seat snap 230. The spray arm seat snap 230 is suitable to be snapped onto a top end of the inner sleeve 320. By providing the spray arm seat snap 230 on the spray arm seat body 210, the spray arm seat 200 and the inner sleeve 320 may be reliably connected as a whole, and the spray arm seat 200 and the ball assembly 300 may be easily connected or disconnected, thereby facilitating the installation of the spray arm assembly 1000.

The top end of the spray arm seat body 210 has a plurality of grooves, and an opening direction of each groove is parallel to an axis direction of the spray arm seat body 210. The spray arm seat snap 230 extends upwardly from a bottom wall of the groove, and two sides of the spray arm seat snap 230 are separated from two side walls of the groove, such that it is ensured that the spray arm seat snap 230 may be elastically deformed in the groove. A top end of the spray arm seat snap 230 is provided with a hook facing the inner sleeve 320. The hook is suitable to hook the top end of the inner sleeve 320, so as to limit an axial position of the spray arm seat 200 relative to the inner sleeve 320.

When the inner sleeve 320 is assembled with the spray arm seat 200, an inner circumferential surface of the inner sleeve 320 squeezes the hook of the spray arm seat snap 230 to make the spray arm seat snap 230 deformed towards an interior of the spray arm seat body 210, and to ensure that the spray arm seat snap 230 may reach the top of the inner sleeve 320 from a bottom end of the inner sleeve 320 (i.e., from bottom to top). When the spray arm seat snap 230 passes over the top end of the inner sleeve 320, a squeezing force imposed on the spray arm seat snap 230 disappears. Under the action of an elastic force of the spray arm seat snap 230 itself, the spray arm seat snap 230 approaches the inner sleeve 320, and the hook hooks the top end of the inner sleeve 320.

When it is necessary to separate the inner sleeve 320 from the spray arm seat 200, it is only necessary to lift the spray arm 100 upwardly, such that the top end of the inner sleeve 320 squeezes the hook, and the hook retracts into the inner sleeve 320; then, the spray arm 100 continues to be lifted, such that the inner sleeve 320 may be separated from the spray arm seat 200.

A plurality of spray arm seat snaps 230 (e.g., four) may be provided at an upper edge of the spray arm seat body 210, and the grooves are in one-to-one correspondence with the spray arm seat snaps 230. The plurality of spray arm seat snaps 230 are distributed evenly along a circumferential direction of the spray arm seat body 210, so as to enhance the stability of the engagement between the spray arm seat snap 230 and the inner sleeve 320.

Further, a gap between lower surfaces of the spray arm connecting sleeve 120, the intermediate sleeve 310, and the inner sleeve 320 and an upper surface of the spray arm seat flange 220 is denoted by L1, and L1 satisfies a relationship: $0\ mm < L1 \leq 1\ mm$. For example, L1 may be 0.3 mm, 0.5 mm, or 0.8 mm. That is, there are gaps between the upper surface of the spray arm seat flange 220 and the lower surface of the spray arm connecting sleeve 120, between the upper surface of the spray arm seat flange 220 and the lower surface of the intermediate sleeve 310, and between the upper surface of the spray arm seat flange 220 and the lower surface of the inner sleeve 320. Therefore, when the spray arm 100 rotates relative to the spray arm seat 200, it is possible to avoid sliding friction between a bottom of the spray arm connecting sleeve 120 and the upper surface of the spray arm seat flange 220, between a bottom of the intermediate sleeve 310 and the upper surface of the spray arm seat flange 220, and between a bottom of the inner sleeve 320 and the upper surface of the spray arm seat flange 220, so as to ensure that there is no sliding contact between the spray arm 100 and the spray arm seat 200 except for the rolling contact with the balls 330 in the ball assembly 300.

By providing the gap, it may be ensured that the spray arm 100 rotates at a high speed and with good stability. In addition, by setting the gap to 0 mm to 1 mm, it is possible to prevent leftovers or other contaminants from entering the gap and increasing the friction between the spray arm 100 and the spray arm seat 200 or even jamming the spray arm 100. Moreover, when the spray arm 100 tilts, the spray arm 100 may quickly come into contact with the spray arm seat 200, thereby preventing the spray arm 100 from being further tilted.

Referring to FIG. 4, the ball hole 311 is provided in a top of the intermediate sleeve 310, the ball hole 311 is a major arc hole, and a top notch of the ball hole 311 forms a ball fetching opening. The ball 330 enters the ball hole 311 or comes out of the ball hole 311 through the ball fetching opening, which facilitates the installation and removal of the ball 330 in the ball hole 311. The major arc hole is a hole with a central angle greater than 180° and less than 360°, so that a major part of each ball 330 may be located in the ball hole 311 to prevent the ball 330 from falling out of the ball hole 311 after the installation is completed. When the ball 330 is mounted, the ball fetching opening may be expanded by an external force, and then the ball 330 may be mounted in the ball hole 311 through the ball fetching opening. Afterwards, the external force is removed, the elastic deformation of the ball hole 311 disappears, and the ball hole 311 is restored to an original state. At this time, the ball hole 311 tightly wraps the ball 330, so that the installation of the ball 330 in the ball hole 311 is more secure and reliable.

Further, a weakening groove 342 is provided between two adjacent ball holes 311. By providing the weakening groove 342, the rigidity between the two adjacent ball holes 311 may be reduced. As a result, the ball hole 311 is easily deformed during the installation of the ball 330, thereby reducing the difficulty of installing or removing the ball 330.

Further, a weakening groove column 341 is provided in the weakening groove 342. Optionally, a central axis of the weakening groove column 341 is parallel to a central axis of the intermediate sleeve 310, thereby simplifying the processing of the intermediate sleeve 310. The weakening groove column 341 may play a strengthening role to a certain extent and prevent the weakening groove 342 from excessively weakening the rigidity of the intermediate sleeve 310, so as to improve the working reliability of the ball assembly 300.

In some embodiments not shown, the ball hole 311 is provided in a bottom of the intermediate sleeve 310, the ball hole 311 is a major arc hole, and a bottom notch of the ball hole 311 forms a ball fetching opening.

In other embodiments not shown, the ball hole 311 may also be provided in a middle of the intermediate sleeve 310, and the ball hole 311 is a complete hole.

The intermediate sleeve 310 mainly has three functions: (1) by providing the ball hole 311 in the intermediate sleeve 310 and installing the ball 330 in the ball hole 311, the position of the ball 330 may be fixed and limited to prevent the ball 330 from congregating; (2) food debris is isolated and prevented from entering the ball groove and causing friction; (3) the intermediate sleeve 310 plays a strengthening role, and may isolate vibration of the spray arm 100 to prevent the spray arm 100 from shaking seriously.

The detachable connection between the spray arm seat 200 and the carrier base may adopt threaded connection in addition to the above snap connection. For example, the carrier base has a base thread, the spray arm seat 200 has a spray arm seat thread, and the spray arm seat thread is fitted with the base thread, so as to realize the connection between the spray arm seat 200 and the carrier base. When the spray arm seat thread and the base thread are unscrewed, the disassembly of the spray arm seat 200 and the carrier base can be realized.

Based on FIG. 3, the detachable connection of the spray arm seat 200 and the inner sleeve 320 may have suitable variations, and these variations fall within the scope of the present disclosure.

For example, in a first embodiment not shown therein, the spray arm seat 200 includes the spray arm seat body 210; the spray arm seat thread is an external thread provided on an outer circumferential surface of the spray arm seat body 210; and the base thread is an internal thread provided on the inner circumferential surface of the inner sleeve 320. That is, compared with the above embodiment shown in FIG. 3, the spray arm seat 200 and the inner sleeve 320 are threadedly connected, and the external thread of the spray arm seat is fitted with the internal thread of the inner sleeve to realize the detachable connection between the spray arm seat 200 and the internal sleeve 320.

As another example, in a second embodiment not shown therein, the spray arm seat 200 includes the spray arm seat body 210. Compared with the embodiment of FIG. 3 described above, the inner sleeve 320 extends downwardly beyond the intermediate sleeve 310; the base thread is an external thread provided on the outer circumferential surface of the inner sleeve 320; the spray arm seat body 210 is sleeved over a part of the inner sleeve 320 extending downwardly beyond the intermediate sleeve 310; the spray arm seat thread is an internal thread provided on an inner circumferential surface of the spray arm seat body 210; the inner circumferential surface of the spray arm seat body 210 is fitted with the outer circumferential surface of the inner sleeve 320. The internal thread of the spray arm seat is fitted with the external thread of the inner sleeve to realize the detachable connection between the spray arm seat 200 and the internal sleeve 320.

Based on the embodiments of FIGS. 1-3, the carrier base of the present disclosure may have suitable variations, and these variations fall within the scope of the present disclosure. A plurality of variations of the carrier base according to the embodiments of the present disclosure will be described below with reference to FIGS. 1-3, and FIG. 6.

For example, in one embodiment not shown, the carrier base may only include the inner sleeve 320, that is, compared with the embodiment of FIG. 3 described above, the intermediate sleeve 310 is omitted. At this time, the ball 330 is in rolling contact with the inner sleeve ball groove 340 in the outer circumferential surface of the inner sleeve 320 and is in rolling contact with the spray arm ball groove 140 in the inner circumferential surface of the spray arm connecting sleeve 120, thereby achieving the rolling connection between the spray arm 100 and the spray arm seat 200.

Figure 6:
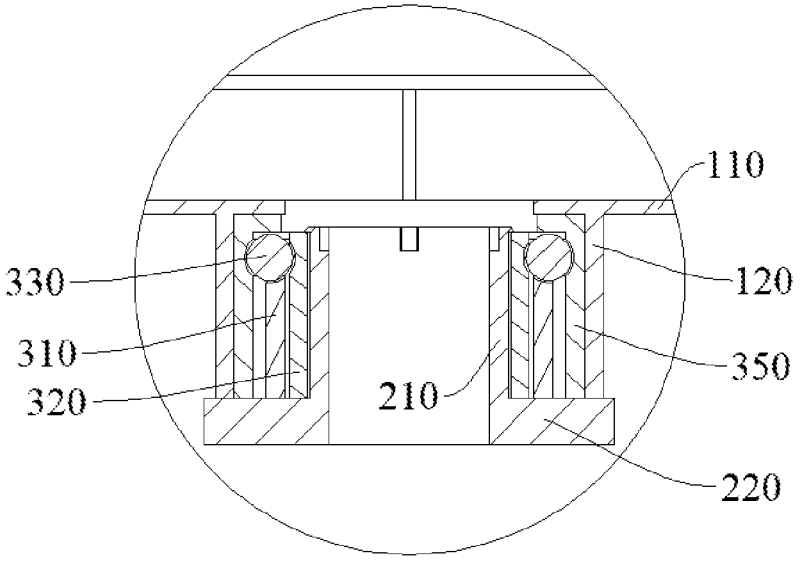
FIG. 6 illustrates a schematic view of a ball assembly.
Figure 7:
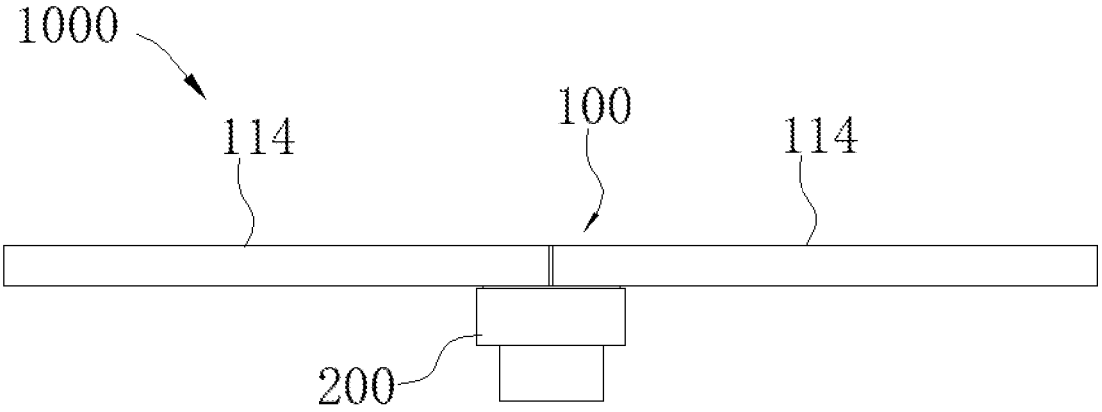
FIG. 7 illustrates a plan view of a spray arm assembly according to embodiments of the present disclosure.

For example, in the embodiment shown in FIG. 6, the carrier base may include the inner sleeve 320, the intermediate sleeve 310, and an outer sleeve 350. The outer sleeve 350 is sleeved over the intermediate sleeve 310. An inner circumferential surface of the outer sleeve 350 is provided with an outer sleeve ball groove fitted with the ball 330. The outer circumferential surface of the inner sleeve 320 is provided with the inner sleeve ball groove 340 fitted with the ball 330. The inner circumferential surface of the spray arm connecting sleeve 120 is in interference fit with an outer circumferential surface of the outer sleeve 350, thereby preventing the ball assembly 300 from falling out of the spray arm connecting sleeve 120. At this time, the ball 330 is in rolling contact with the inner sleeve ball groove 340 in the outer circumferential surface of the inner sleeve 320 and is in rolling contact with the outer sleeve ball groove in the inner circumferential surface of the outer sleeve 350, thereby achieving the rolling connection between the spray arm 100 and the spray arm seat 200.

For example, in another embodiment not shown, the carrier base may include: the inner sleeve 320 and the outer sleeve 350, that is, compared with the embodiment of FIG. 6 described above, the intermediate sleeve 310 is omitted. The outer sleeve 350 is sleeved over the inner sleeve 320. The inner circumferential surface of the outer sleeve 350 is provided with the outer sleeve ball groove fitted with the ball 330. The outer circumferential surface of the inner sleeve 320 is provided with the inner sleeve ball groove 340 fitted with the ball 330. The inner circumferential surface of the spray arm connecting sleeve 120 is in interference fit with the outer circumferential surface of the outer sleeve 350, thereby preventing the ball assembly 300 from falling out of the spray arm connecting sleeve 120. At this time, the ball 330 is in rolling contact with the inner sleeve ball groove 340 in the outer circumferential surface of the inner sleeve 320 and is in rolling contact with the outer sleeve ball groove in the inner circumferential surface of the outer sleeve 350, thereby achieving the rolling connection between the spray arm 100 and the spray arm seat 200. In such a case, the ball assembly 300 is an independent modular component, which is convenient to install and remove, thereby reducing the processing cost of the spray arm seat 200 or the spray arm 100.

The spray arm assembly 1000 according to embodiments of the present disclosure will be described in detail below with reference to FIGS. 7-12.

Referring to FIGS. 7-12, the spray arm assembly 1000 according to the embodiments of the present disclosure may be used for the washing appliance 10000. The spray arm assembly 1000 includes the spray arm 100 and the spray arm seat 200. The spray arm seat 200 includes a mounting portion 122, and the mounting portion 122 defines a mounting space 1222. The spray arm 100 is provided with a water introduction shaft 112, and the water introduction shaft 112 is at least partially mounted in the mounting space 1222. The ball 330 is disposed between an outer side surface of the water introduction shaft 112 located in the mounting space 1222 and an inner side surface of the mounting portion 122, and the ball 330 may rollably connect the water introduction shaft 112 and the mounting portion 122.

In the spray arm assembly 1000 according to the embodiments of the present disclosure, the water may flow from the spray arm seat 200 to the spray arm 100 through the water introduction shaft 112, and the spraying of the water outwardly from the spray arm 100 may push the spray arm 100 to rotate. During the rotation of the spray arm 100, the ball 330 may realize the rolling friction between the spray arm 100 and the spray arm seat 200, so a friction force between the spray arm 100 and the spray arm seat 200 is a rolling friction force, which reduces the loss of the power for driving the spray arm 100 to rotate, and improves the utilization rate of the power for driving the spray arm 100 to rotate. As a result, the pressure of the water after being sprayed outwardly from the spray hole of the spray arm 100 is increased, which is beneficial to upgrading the cleaning effect of the spray arm assembly 1000.

For example, in some embodiments, the diameter of the ball 330 is 3 mm to 8 mm. The ball 330 may be a steel ball or a plastic ball. A surface of the ball 330 may be coated with a lubricating material to reduce the rolling friction force between the spray arm 100 and the spray arm seat 200 and further improve the efficiency of the power for the spray arm 100.

Figure 8:
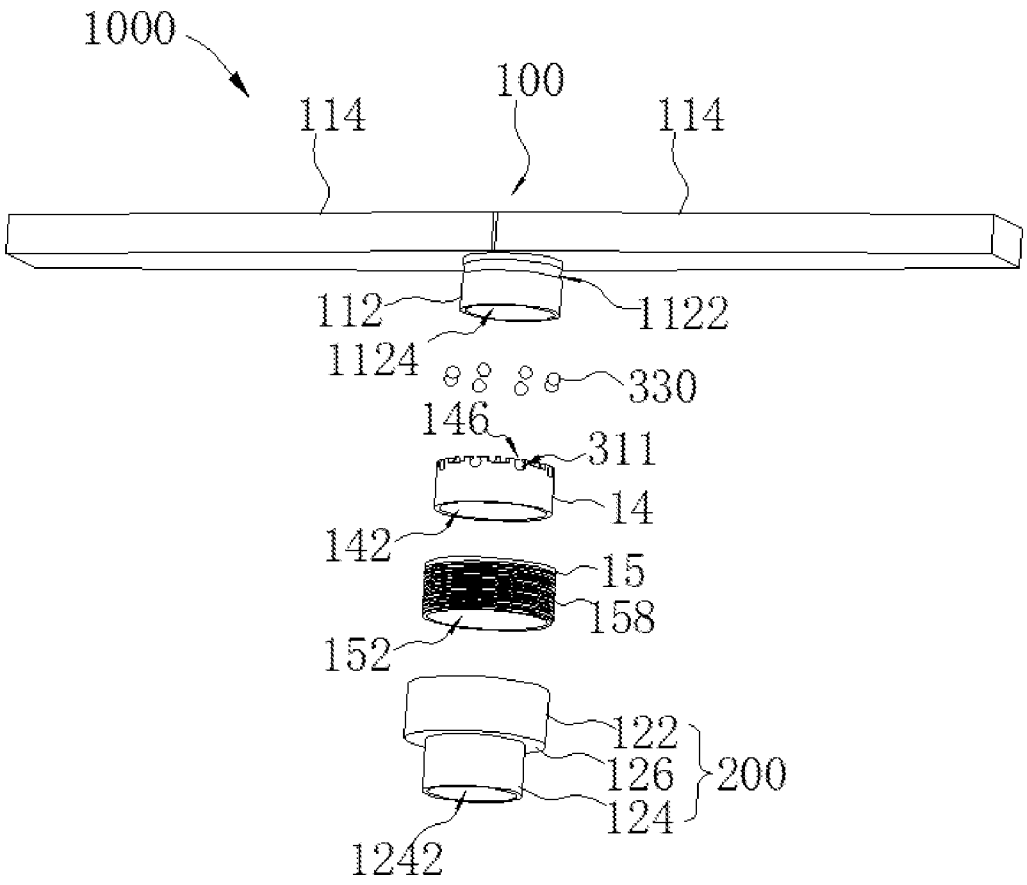
FIG. 8 illustrates an exploded view of a spray arm assembly according to embodiments of the present disclosure.
Figure 9:
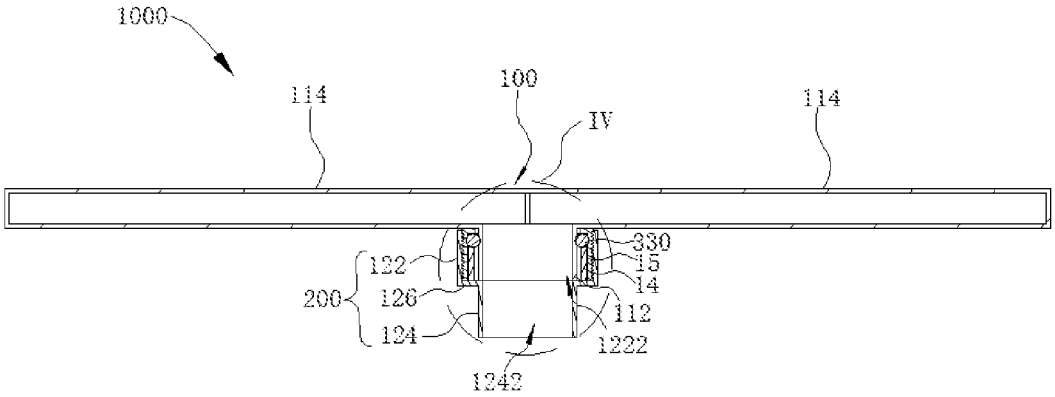
FIG. 9 illustrates a section view of a spray arm assembly according to embodiments of the present disclosure.
Figure 10:
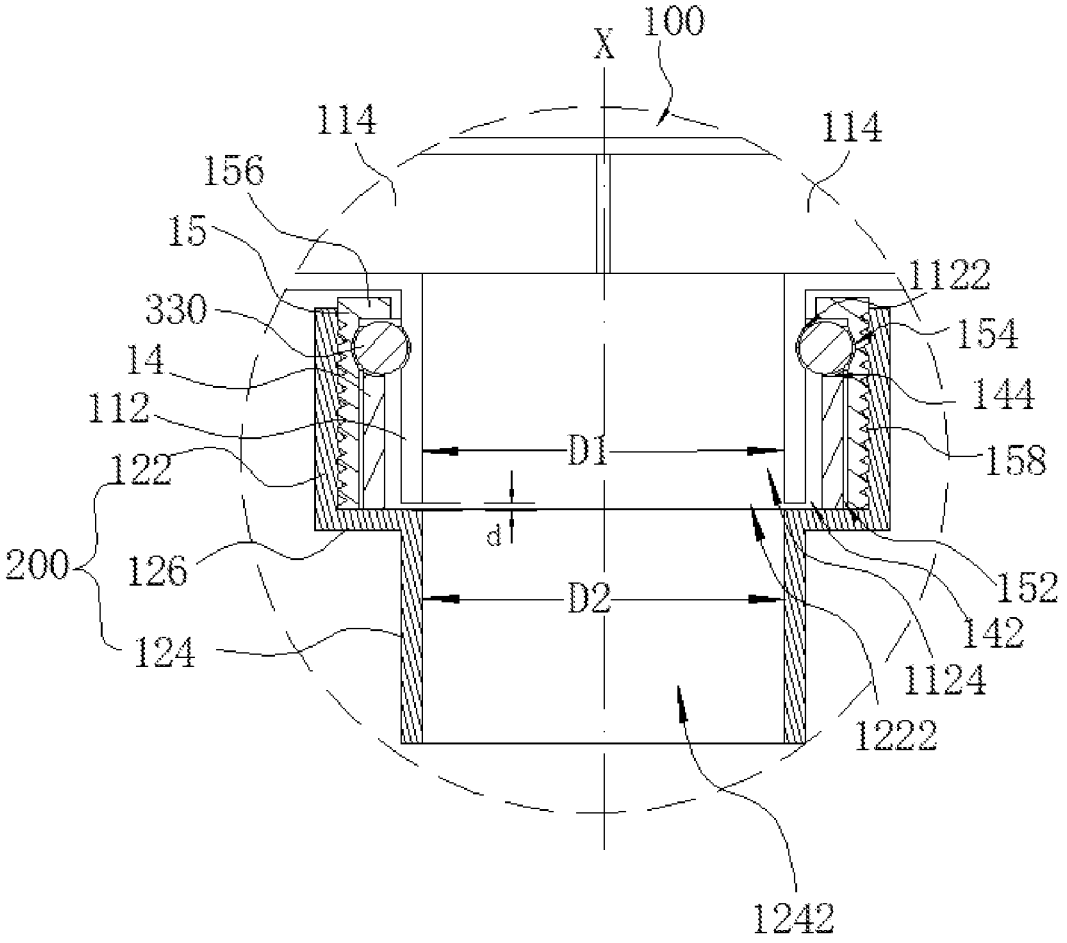
FIG. 10 illustrates an enlarged view of area IV of the spray arm assembly in FIG. 9.
Figure 11:
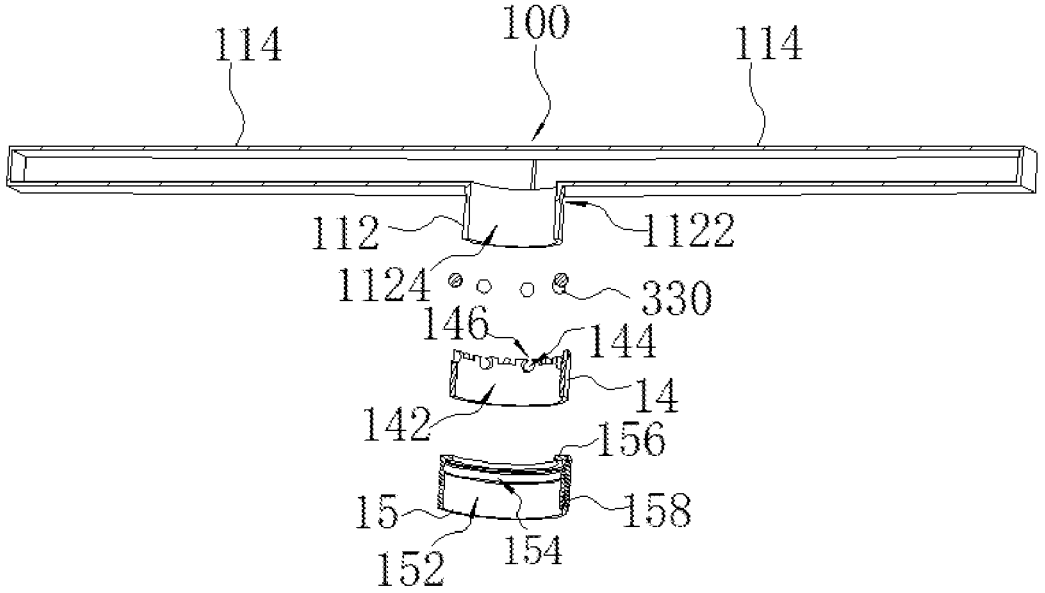
FIG. 11 illustrates a perspective exploded view of a spray arm assembly according to embodiments of the present disclosure.

Referring to FIGS. 8 and 10, in some embodiments, the outer side surface of the water introduction shaft 112 is provided with a first ball groove 1122 along a circumferential direction of the water introduction shaft 112, and the ball 330 is partially accommodated in the first ball groove 1122.

In this way, the ball 330 is partially located in the first ball groove 1122 to maintain the stability of cooperation between the ball 330 and the water introduction shaft 112, so that it is not easy for the ball 330 to come out, and the displacement of the spray arm 100 along an axis X of the water introduction shaft 112 may be restricted to a certain extent, thereby improving the reliability of the spray arm assembly 1000.

For example, the first ball groove 1122 exhibits an annular groove along the outer side surface of the water introduction shaft 112, and an inner wall of the first ball groove 1122 has an arc shape. In this way, the ball 330 is fitted with the inner wall of the first ball groove 1122, and the spray arm 100 may rotate around the axis X of the water introduction shaft 112 smoothly.

In some embodiments, the spray arm assembly 1000 includes a first connecting shaft 14 accommodated in the mounting space 1222. The first connecting shaft 14 is located between the outer side surface of the water introduction shaft 112 and the inner side surface of the mounting portion 122. The first connecting shaft 14 is provided with a first shaft through-hole 142, and the water introduction shaft 112 passes through the first shaft through-hole 142. An upper end of the first connecting shaft 14 is provided with a ball hole 311, and the ball 330 is partially accommodated in the ball hole 311.

In this way, the ball hole 311 may further limit the position of the ball 330. In a process of assembling the spray arm assembly 1000, the ball 330 is first mounted to the first connecting shaft 14, and then the first connecting shaft 14 with the ball 330 is mounted between the outer side surface of the water introduction shaft 112 and the inner side surface of the mounting portion 122, which facilitates the assembling of the spray arm assembly 1000.

In some embodiments, a center of the ball hole 311 is horizontally aligned with a center of the first ball groove 1122. In this way, while the ball hole 311 restricts the position of the ball 330, the ball 330 and the water introduction shaft 112 are in contact with each other and generate rolling friction.

In some embodiments, a plurality of the balls 330 are provided, a plurality of the ball holes 311 are provided, and the balls 330 are in one-to-one correspondence with the ball holes 311. The plurality of the balls 330 are evenly distributed along a circumferential direction of the first connecting shaft 14. In this way, the plurality of the balls 330 is beneficial to enhancing the stability of the rotation of the spray arm 100.

For example, in some embodiments, the number of the balls 330 is an even number. The plurality of the ball holes are symmetrically distributed about an axis of the first connecting shaft 14, so that the plurality of the balls 330 are symmetrically distributed about the axis of the first connecting shaft 14. In this way, when the spray arm 100 rotates, it may ensure that portions where rolling friction is generated are evenly stressed, thereby enhancing the reliability of the spray arm assembly 1000. In the embodiment of the present disclosure, the axis of the first connecting shaft 14 coincides with the axis X of the water introduction shaft 112.

Further, in one example, the number of the balls 330 is 4 to 12.

In other embodiments, the number of the balls 330 and the number of the ball holes 311 may not be limited to the embodiments discussed above, but may be flexibly set as needed.

In some embodiments, the upper end of the first connecting shaft 14 is formed with a notch 146 in an upper portion of the ball hole 311. In this way, when the ball 330 is mounted to the first connecting shaft 14, the ball 330 is squeezed and the ball hole 311 is slightly deformed, so that the ball 330 may be stably mounted to the position of the ball hole 311. The first connecting shaft 14 may simultaneously mount the plurality of the balls 330 into the space between the outer side surface of the water introduction shaft 112 and the inner side surface of the mounting portion 122, which facilitates the assembling of the spray arm assembly 1000. When the first connecting shaft 14 is mounted between the outer side surface of the water introduction shaft 112 and the inner side surface of the mounting portion 122, the balls 330 cooperate with the outer side surface of the water introduction shaft 112 and the inner side surface of the mounting portion 122, so that the ball 330 may resume rolling.

In some embodiments, the spray arm assembly 1000 includes a second connecting shaft 15. The second connecting shaft 15 is at least partially accommodated in the mounting space 1222 and is connected to the mounting portion 122. The second connecting shaft 15 is provided with a second shaft through-hole 152, and the water introduction shaft 112 passes through the second shaft through-hole 152. The ball 330 may rollably connect the outer side surface of the water introduction shaft 112 and an inner side surface of the second connecting shaft 15.

In this way, the water introduction shaft 112 may rotate relative to the second connecting shaft 15, and the water introduction shaft 112 and the second connecting shaft 15 may achieve rolling friction with the ball 330. It can be understood that the spray arm seat 200 is usually fixedly mounted in a cavity 20. When the spray arm assembly 1000 is assembled, the spray arm 100, the second connecting shaft 15, and the ball 330 are first assembled. Since the spray arm 100 is rotatable relative to the second connecting shaft 15, a rotation effect of the spray arm 100 may be first tested, and then be fixedly connected to the spray arm seat 200 through the second connecting shaft 15 after the test is completed. The addition of the second connecting shaft 15 allows the spray arm 100 to undergo the rotation effect test before being mounted to the spray arm seat 200, which facilitates the debugging of the rotation of the spray arm 100 and the assembling of the spray arm assembly 1000.

In one embodiment, the second connecting shaft 15 is fixedly connected to the mounting portion 122. In other embodiments, the second connecting shaft 15 may also be relatively rotatably connected to the mounting portion 122, and the second connecting shaft 15 and the mounting portion 122 may also be connected in a rolling manner.

In some embodiments, the inner side surface of the second connecting shaft 15 is provided with a second ball groove 154 along a circumferential direction of the second connecting shaft 15, and the ball 330 is partially accommodated in the second ball groove 154.

In this way, the second ball groove 154 may define the position of the ball 330, which limits the displacement of the spray arm 100 in a direction of the axis X of the water introduction shaft 112 to a certain extent, so that the ball 330 cooperates with the second connecting shaft 15 and the water introduction shaft 112 more stably.

For example, the second ball groove 154 forms an annular groove along the inner side surface of the second connecting shaft 15, and an inner wall of the second ball groove 154 has an arc shape. In this way, the ball 330 is fitted with the inner wall of the second ball groove 154, and the spray arm 100 may rotate around the axis X of the water introduction shaft 112 smoothly Further, in the illustrated embodiment of the present disclosure, the water introduction shaft 112 is provided with the first ball groove 1122, the second connecting shaft 15 is provided with the second ball groove 154, and the first ball groove 1122 and the second ball groove 154 are located on two opposite sides of the ball, so that the first ball groove 1122 and the second ball groove 154 may jointly define the position of the ball between the outer side surface of the water introduction shaft 112 and the second connecting shaft 15, and the spray arm 100 rotates more smoothly.

For example, the first ball groove 1122 and the second ball groove 154 are horizontally aligned. In this way, the ball 330 may cooperate with the first ball groove 1122 and the second ball groove 154 more stably.

In the illustrated embodiment, one first ball groove 1122 and one second ball groove 154 are provided. In other embodiments, the number of the first ball grooves 1122 and that of the second ball grooves 154 may not be limited to one. For example, a plurality of first ball grooves 1122 may be formed in the outer side surface of the water introduction shaft 112 along the direction of the axis X of the water introduction shaft 112. Correspondingly, a plurality of second ball grooves 154 may be formed in the inner side surface of the second connecting shaft 15 along an axis of the second connecting shaft 15. The plurality of first ball grooves 1122 are in one-to-one correspondence with the plurality of second ball grooves 154. The balls 330 are located between the plurality of first ball grooves 1122 and the plurality of second ball grooves 154. In this way, the stability of the connection of the spray arm 100 may be enhanced, and the spray arm 100 rotates more smoothly, which helps to improve the reliability of the spray arm assembly 1000.

In some embodiments, a flange 156 protruding toward the axis of the second connecting shaft 15 is formed at an upper end of the second connecting shaft 15, and the flange 156 partially blocks the ball 330.

In this way, the flange 156 may block the ball 330 so that the ball 330 is better accommodated between the second connecting shaft 15 and the water introduction shaft.

For example, a diameter of the second shaft through-hole 152 formed by the flange 156 at the upper end of the second connecting shaft 15 is adapted with respect to an outer diameter of the water introduction shaft 112, so that the water introduction shaft 112 may be at least partially accommodated in the second shaft through-hole 152. The flange 156 and the ball 330 cooperate, so that when the water introduction shaft 112 is mounted in the second shaft through-hole 152, the shaking of the spray arm 100 may be reduced. At the same time, the cooperation of the flange 156 and the water introduction shaft 112 may prevent debris from entering the second shaft through-hole 152 from the upper end of the second connecting shaft 15 and getting the ball 330 stuck, and may be beneficial to enhancing the reliability of the spray arm assembly 1000. The flange 156 and the second connecting shaft 15 may be an integrally formed structure, or the flange 156 may be detachably mounted on the upper end of the second connecting shaft 15.

In some embodiments, the spray arm 12 includes two sub-arms 114 arranged symmetrically with respect to the water introduction shaft 112, and an upper end surface of the second connecting shaft 15 is spaced from lower surfaces of the sub-arms 114. A distance between the upper end surface of the second connecting shaft 15 and the lower surfaces of the sub-arms 114 may avoid contact between the lower surfaces of the sub-arms 114 and the second connecting shaft 15. When the spray arm 100 rotates, no sliding friction will be produced between the lower surfaces of the sub-arms 114 and the spray arm seat 200, and the loss of power for driving the spray arm 100 to rotate is further reduced, improving the efficiency of the power for driving the spray arm 100 to rotate, increasing the pressure of water after being sprayed from the spray hole of the spray arm 100, and upgrading the cleaning effect of the spray arm assembly 1000.

For example, in one example, an upper surface of the flange 156 is spaced from a lower surface of the sub-arm 114.

In other embodiments, the number of the sub-arms 114 may not be limited to two, but three or more sub-arms 114 may be provided according to actual needs, which is not specifically limited herein.

In some embodiments, the outer side surface of the second connecting shaft 15 is formed with a thread 158, and the inner side surface of the mounting portion 122 is formed with a thread correspondingly. In this way, the second connecting shaft 15 and the mounting portion 122 are fixedly connected by the thread fit.

In other embodiments, the second connecting shaft 15 and the mounting portion 122 may also be fixedly connected by snap fit, interference fit, or in other connection manners, which is not specifically limited herein.

It should be noted that, in some embodiments, the spray arm assembly 1000 may omit the second connecting shaft 15, and the second ball groove 154 may be formed in the inner side surface of the mounting portion 122. Similarly, the spray arm 100 may smoothly rotate about the axis X of the water introduction shaft 112, relative to the spray arm seat 200. Accordingly, the flange 156 may be located at an upper end of the mounting portion 122 and partially block the ball 330. The flange 156 may be designed to be detachably mounted on the upper end of the mounting portion 122, so that the ball 330 may be easily mounted between the inner side surface of the mounting portion 122 and the outer side surface of the water introduction shaft 112 from above the mounting space 1222.

Further, in the illustrated embodiment, the first connecting shaft 14 is located between the outer side surface of the water introduction shaft 112 and the inner side surface of the second connecting shaft 15. In this way, the first connecting shaft 14 with the ball 330 may be mounted between the outer side surface of the water introduction shaft 112 and the inner side surface of the second connecting shaft 15, which facilitates the assembling of the spray arm assembly 1000.

In some embodiments, the spray arm seat 200 includes a water introduction portion 124 connected to the mounting portion 122. The water introduction shaft 112 and the water introduction portion 124 are coaxially disposed. The water introduction shaft 112 is provided with a first water introduction through-hole 1124. The water introduction portion 124 is provided with a second water introduction through-hole 1242. A diameter D1 of the first water introduction through-hole 1124 is equal to a diameter D2 of the second water introduction through-hole 1242.

It could be understood that the water introduction portion 124 and the water introduction shaft 112 may exhibit a circular tube shape, and the coaxial arrangement of the water introduction shaft 112 and the water introduction portion 124 may align the first water introduction through-hole 1124 with the second water introduction through-hole 1242, so that the water flowing out of the second water introduction through-hole 1242 may smoothly enter the first water introduction through-hole 1124 to reach the spray arm 100, and a water flow path in the spray arm assembly 1000 may keep stable and smooth.

Referring to FIG. 10, in some embodiments, the spray arm seat 200 includes a step portion 126 connecting the mounting portion 122 and the water introduction portion 124. A gap d of 0.4 to 2.2 mm is formed between a bottom of the water introduction shaft 112 and the step portion 126.

In this way, the gap d may avoid the contact between the bottom of the water introduction shaft 112 and the spray arm seat 200. When the spray arm 100 rotates, no sliding friction will be generated between the bottom of the water introduction shaft 112 and the spray arm seat 200, the loss of the power for the rotation of the spray arm 100 is further reduced, the efficiency of the power for driving the spray arm 100 to rotate is improved, the pressure of the water after being sprayed out of the spray hole of the spray arm 100 is increased, and the cleaning effect of the spray arm assembly 1000 is upgraded. In addition, the fact that the gap d is relatively small may reduce the outflow of water through the gap d, and prevent debris in the water from entering between the water introduction shaft 112 and the mounting portion 122 through the gap d and affecting the rolling of the ball 330.

In some embodiments, referring to FIG. 10, the second connecting shaft 15 and the first connecting shaft 14 are disposed above the step portion 126.

Figure 12:
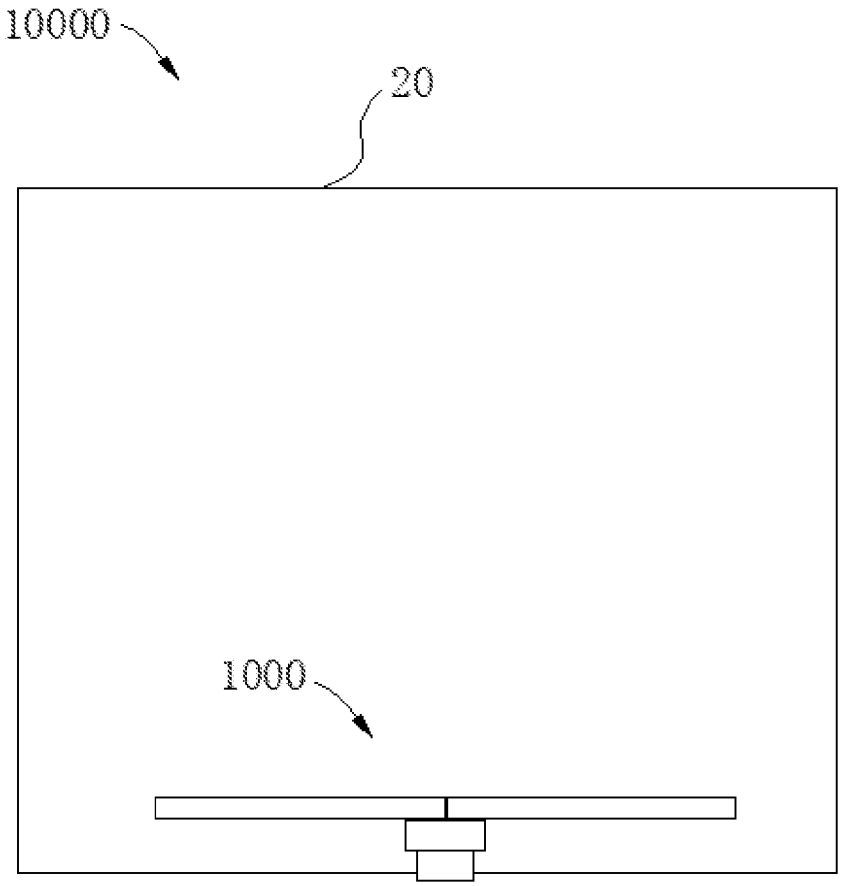
FIG. 12 illustrates a plan view of a washing appliance according to embodiments of the present disclosure.

Referring to FIG. 12, the washing appliance 10000 according to embodiments of the present disclosure includes the spray arm assembly 1000 in any one of the above embodiments.

Further, the washing appliance 10000 further includes a cavity 20, the spray arm assembly 1000 is mounted in the cavity 20, and the spray arm 100 is located in the cavity 20.

In the above washing appliance 10000, when the spray arm 100 of the spray arm assembly 1000 rotates, the ball 330 may realize the rolling friction between the spray arm 100 and the spray arm seat 200, so that the friction force between the spray arm 100 and the spray arm seat 200 is the rolling friction force. As a result, the loss of the power for driving the spray arm 100 to rotate is reduced, the efficiency of the power for driving the spray arm 100 to rotate is improved, the pressure of the water after being sprayed out of the spray hole of the spray arm 100 is increased, and the cleaning effect of the spray arm assembly 1000 and the washing appliance 10000 is upgraded. Since the spray arm assembly 1000 is assembled using the balls 330, the mounting space 1222 required is small, which may maximize the internal space of the washing appliance 10000 and increase the inner capacity of the cavity 20 by 10 mm to 40 mm. The cavity 20 is used to place items to be cleaned, such as the tableware.

In the illustrated embodiment, the spray arm assembly 1000 is a lower spray arm assembly 1000 of the washing appliance 10000 and is mounted at a bottom of the cavity 20. In other embodiments, the spray arm assembly 1000 may also be used in other positions, such as an upper spray arm 100 and a middle spray arm 100. Accordingly, the spray arm assembly 1000 may be mounted on a top of and a side wall of the cavity 20, which will not be specifically limited herein.

The washing appliance 10000 may be a washing appliance such as a dishwasher that uses the spray arm 100 to wash items.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of these phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art may combine and incorporate different embodiments or examples described in this specification.

Although explanatory embodiments have been shown and described, it would be appreciated by those skilled in the art that the above embodiments are exemplary and shall not be constructed to limit the present disclosure, and various changes, modifications, alternatives and variations may be made in the embodiments without departing from the scope of the present disclosure.

What is claimed is:

1. A spray arm assembly comprising:

a spray arm;

a spray arm seat, the spray arm being connected to the spray arm seat and being rotatable with respect to the spray arm seat;

a plurality of balls provided at a position where the spray arm is connected to and fitted with the spray arm seat; and a carrier base, wherein the carrier base comprises:

an inner sleeve; and an intermediate sleeve fitted over the inner sleeve, the intermediate sleeve being provided with a plurality of ball holes, the plurality of balls being mounted in the plurality of ball holes respectively, wherein the plurality of balls protrude beyond an inner circumferential surface and an outer circumferential surface of the intermediate sleeve in a radial direction of the intermediate sleeve.

2. The spray arm assembly according to claim 1, wherein the carrier base and the plurality of balls form a ball assembly, the ball assembly is arranged at the position where the spray arm is connected to and fitted with the spray arm seat, and the plurality of balls are rotatably arranged on the carrier base.

3. The spray arm assembly according to claim 2, wherein an outer circumferential surface of the inner sleeve is provided with an inner sleeve ball groove fitted with the plurality of balls.

4. The spray arm assembly according to claim 3, wherein:

the spray arm comprises a spray arm body and a spray arm connecting sleeve;

the spray arm connecting sleeve is arranged on a lower side of the spray arm body; and an inner circumferential surface of the spray arm connecting sleeve is provided with a spray arm ball groove fitted with the plurality of balls.

5. The spray arm assembly according to claim 4, wherein:

the spray arm seat comprises a spray arm seat body and a spray arm seat flange extending outwardly along a radial direction of the spray arm seat body;

the ball assembly is arranged above the spray arm seat flange; and a gap between lower surfaces of the spray arm connecting sleeve and the inner sleeve and an upper surface of the spray arm seat flange is represented by L1, and L1 satisfies a relationship: $0\ mm<L1\leq 1\ mm$.

6. The spray arm assembly according to claim 3, wherein the spray arm seat and the carrier base are detachably connected.

7. The spray arm assembly according to claim 6, wherein:

the spray arm seat comprises a spray arm seat body;

the spray arm seat body has a spray arm seat snap; and the spray arm seat snap is configured to be snapped onto a top end of the inner sleeve.

8. The spray arm assembly according to claim 7, wherein:

a top end of the spray arm seat body has a plurality of grooves, and an opening direction of each groove is parallel to an axis direction of the spray arm seat body;

the spray arm seat snap extends upwardly from a bottom wall of the groove, and two sides of the spray arm seat snap are separated from two side walls of the groove; and a top end of the spray arm seat snap is provided with a hook facing the inner sleeve.

9. The spray arm assembly according to claim 6, wherein the carrier base has a base thread, the spray arm seat has a spray arm seat thread, and the spray arm seat thread is fitted with the base thread.

10. The spray arm assembly according to claim 9, wherein:

the spray arm seat comprises a spray arm seat body; the spray arm seat thread is an internal thread provided on an inner circumferential surface of the spray arm seat body; and the base thread is an external thread provided on the outer circumferential surface of the inner sleeve; or the spray arm seat comprises a spray arm seat body; the spray arm seat thread is an external thread provided on an outer circumferential surface of the spray arm seat body; and the base thread is an internal thread provided on an inner circumferential surface of the inner sleeve.

11. The spray arm assembly according to claim 1, wherein the carrier base further comprises an outer sleeve, and an inner circumferential surface of the outer sleeve is provided with an outer sleeve ball groove fitted with the plurality of balls.

12. The spray arm assembly according to claim 11, wherein:

the spray arm comprises a spray arm body and a spray arm connecting sleeve;

the spray arm connecting sleeve is arranged on a lower side of the spray arm body; and an inner circumferential surface of the spray arm connecting sleeve is in interference fit with an outer circumferential surface of the outer sleeve.

13. The spray arm assembly according to claim 1, wherein each ball hole is provided in a top of the intermediate sleeve, each ball hole is a major arc hole, and a top notch of each ball hole forms a ball fetching opening.

14. The spray arm assembly according to claim 13, wherein a weakening groove is provided between two adjacent ball holes, and a weakening groove column is provided in the weakening groove.

15. A washing appliance, comprising a spray arm assembly according to claim 1.

16. The washing appliance according to claim 15, further comprising a cavity, the spray arm assembly being mounted in the cavity and the spray arm being located in the cavity.

17. A spray arm assembly comprising:

a spray arm;

a spray arm seat, the spray arm being connected to the spray arm seat and being rotatable with respect to the spray arm seat; and a plurality of balls provided at a position where the spray arm is connected to and fitted with the spray arm seat, wherein:

the spray arm assembly is applied in a washing appliance;

the spray arm seat comprises a mounting portion, and the mounting portion defines a mounting space;

the spray arm is provided with a water introduction shaft, and the water introduction shaft is at least partially mounted in the mounting space; and the plurality of balls are arranged between an outer side surface of the water introduction shaft located in the mounting space and an inner side surface of the mounting portion, and the plurality of balls rollably connect the water introduction shaft and the mounting portion.

18. The spray arm assembly according to claim 17, wherein the outer side surface of the water introduction shaft is provided with a first ball groove along a circumferential direction of the water introduction shaft, and each ball is partially accommodated in the first ball groove.

19. The spray arm assembly according to claim 18, wherein:

the spray arm assembly comprises a first connecting shaft accommodated in the mounting space;

the first connecting shaft is located between the outer side surface of the water introduction shaft and the inner side surface of the mounting portion;

the first connecting shaft is provided with a first shaft through-hole, and the water introduction shaft passes through the first shaft through-hole; and an upper end of the first connecting shaft is provided with a ball hole, and the ball is partially accommodated in the ball hole.

20. The spray arm assembly according to claim 19, wherein a center of the ball hole is horizontally aligned with a center of the first ball groove.

21. The spray arm assembly according to claim 17, wherein:

the spray arm assembly comprises a second connecting shaft;

the second connecting shaft is at least partially accommodated in the mounting space and is connected to the mounting portion;

the second connecting shaft is provided with a second shaft through-hole, and the water introduction shaft passes through the second shaft through-hole; and the plurality of balls rollably connect the outer side surface of the water introduction shaft and an inner side surface of the second connecting shaft.

22. The spray arm assembly according to claim 21, wherein the inner side surface of the second connecting shaft is provided with a second ball groove along a circumferential direction of the second connecting shaft, and each ball is partially accommodated in the second ball groove.

23. The spray arm assembly according to claim 21, wherein a flange protruding toward an axis of the second connecting shaft is formed at an upper end of the second connecting shaft, and the flange partially blocks the plurality of balls.

24. The spray arm assembly according to claim 21, wherein an outer side surface of the second connecting shaft is provided with a thread, the inner side surface of the mounting portion is provided with a thread correspondingly, and the second connecting shaft and the mounting portion are connected by engagement between the threads.

25. The spray arm assembly according to claim 17, wherein:

the spray arm seat comprises a water introduction portion connected to the mounting portion;

the water introduction portion and the water introduction shaft are coaxially arranged; and the water introduction shaft is provided with a first water introduction through-hole, the water introduction portion is provided with a second water introduction through-hole, and a diameter of the first water introduction through-hole is substantially equal to a diameter of the second water introduction through-hole.

26. The spray arm assembly according to claim 17, wherein the spray arm seat comprises a step portion connecting the mounting portion and the water introduction portion, and a gap of 0.4 to 2.2 mm is defined between a bottom of the water introduction shaft and the step portion.

* * * * *